US011268225B2

(12) United States Patent
Kallenbach et al.

(10) Patent No.: US 11,268,225 B2
(45) Date of Patent: Mar. 8, 2022

(54) SEWING MACHINE

(71) Applicant: PFAFF Industriesysteme und Maschinen GmbH, Kaiserslautern (DE)

(72) Inventors: Harald Kallenbach, Heltersberg (DE); Berthold Becker, Rimbach (DE); Stefan Samstag, Lorsch (DE)

(73) Assignee: PFAFF Industriesysteme und Maschinen GmbH, Kaiserslautern (DE)

( * ) Notice: Subject to any disclaimer, the term of this patent is extended or adjusted under 35 U.S.C. 154(b) by 0 days.

(21) Appl. No.: 16/975,230

(22) PCT Filed: Mar. 4, 2019

(86) PCT No.: PCT/EP2019/055326
§ 371 (c)(1),
(2) Date: Aug. 24, 2020

(87) PCT Pub. No.: WO2019/201501
PCT Pub. Date: Oct. 24, 2019

(65) Prior Publication Data

US 2020/0399806 A1 Dec. 24, 2020

(30) Foreign Application Priority Data

Apr. 17, 2018 (DE) ..... 10 2018 205 835.0

(51) Int. Cl.
*D05B 73/02* (2006.01)
*D05B 1/08* (2006.01)
(Continued)

(52) U.S. Cl.
CPC ..... *D05B 73/02* (2013.01); *D05B 1/08* (2013.01); *D05B 21/00* (2013.01); *D05B 73/06* (2013.01); *D05B 69/08* (2013.01)

(58) Field of Classification Search
CPC ..... D05B 23/00; D05B 37/02; D05B 69/30; D05B 73/02; D05B 73/06; D05B 1/08; D05B 69/08; D05B 21/00
See application file for complete search history.

(56) References Cited

U.S. PATENT DOCUMENTS 361,426 A 4/1887 Looker
3,799,089 A * 3/1974 Tolle ..... D05B 3/06 112/217.3

(Continued)

FOREIGN PATENT DOCUMENTS

CN 202247280 U 5/2012
DE 2036697 A1 1/1972

(Continued)

*Primary Examiner* — Danny Worrell
(74) *Attorney, Agent, or Firm* — Smartpat PLC

(57) ABSTRACT

Sewing machine with a sewing machine housing (2) comprising a lower housing part (3), an upper housing part (4) with a sewing head (6) and a stand (5), which connects the lower housing part (3) to the upper housing part (4), wherein the upper housing part (4) comprises a stand-side arm housing section (7), a head-side arm housing section (8) and a joint (23), wherein the joint (23) is arranged in such a manner that the head-side arm housing section (8) can be swiveled between a preparation position for the picking up/delivering of a sewing material and a sewing position for sewing the sewing material.

9 Claims, 6 Drawing Sheets

(51) Int. Cl.

| | |
|---|---|
| ***D05B 21/00*** | (2006.01) |
| ***D05B 73/06*** | (2006.01) |
| *D05B 69/08* | (2006.01) |

(56) References Cited

U.S. PATENT DOCUMENTS

| | | | | |
|---|---|---|---|---|
| 4,520,744 | A * | 6/1985 | Portilla ..... | D05B 73/02 108/20 |
| 4,691,651 | A | 9/1987 | Junemann | |
| 5,095,834 | A | 3/1992 | Braun | |
| 5,651,322 | A | 7/1997 | Koike | |
| 5,875,726 | A | 3/1999 | Keilmann | |
| 7,347,152 | B1 | 3/2008 | Wu et al. | |
| 2017/0260670 | A1 | 9/2017 | Freer et al. | |
| 2018/0313012 | A1 | 11/2018 | Kallenbach et al. | |

FOREIGN PATENT DOCUMENTS

| | | | |
|---|---|---|---|
| DE | 3516734 | A1 | 11/1986 |
| DE | 3518474 | A1 | 11/1986 |
| DE | 4431318 | A1 | 3/1996 |
| DE | 10224001 | A1 | 12/2003 |
| DE | 102015220332 | A1 | 4/2017 |
| GB | 2277101 | A | 10/1994 |
| WO | 8909851 | A1 | 10/1989 |

* cited by examiner

SEWING MACHINE

CROSS-REFERENCE TO RELATED APPLICATIONS

The present patent application is a national phase entry of international application PCT/EP2019/055326, filed 4 Mar. 2019, and claims the priority of German patent application DE 10 2018 205 835.0, filed 17 Apr. 2018, the contents of which are incorporated by reference herein.

TECHNICAL FIELD

The disclosure relates to a sewing machine and a sewing unit with a sewing machine along with method of sewing.

BACKGROUND

A sewing machine and a sewing unit is known in form of the RS 562 sewing machine and the KL 500 sewing unit of the applicant. In addition, a sewing machine 3590 vario of the applicant is known.

SUMMARY

It is a task of the present disclosure to further develop a sewing machine of the type mentioned above in such a manner that an improved ability to access or process the sewing material, which is in particular applied to a sewing material carrier body or a sewing material template, is ensured.

This task is solved by a sewing machine with a sewing machine housing. The housing includes a housing lower part and a housing upper part with a sewing head. A stand connects the housing lower part to the housing upper part. The housing upper part includes a stand-side arm housing section, a head-side arm housing section, and a joint between the stand-side arm housing section and the head-side arm housing section. The joint is arranged in such a manner that the head-side arm housing section can be swiveled between a preparation position for the picking up/delivery of sewing material and a sewing position for sewing the sewing material.

By swiveling the head-side arm housing section into the preparation position for picking up/delivering a sewing material, the gap between the stitch-forming components in the sewing head and the stitch-forming components of the lower housing section is increased, such that the picking up of the sewing material, which is particularly applied to a sewing material carrier body or a sewing material template, is made easier. This reduces the risk of damage to the sewing material during feeding to the stitch-forming components or removal from the stitch-forming components. This is particularly advantageous for touch-sensitive materials. This is particularly the case with a sewing material consisting of a composite material comprising several layers, wherein one of which is a so-called "slush skin". Such a slush skin can be produced with a powder sintering process. Such materials are preferably used for vehicle interior components such as dashboard supports, armrests, console covers or door panels. Commonly, such vehicle interior components are provided with an ornamental seam; that is, a seam that does not serve as a component connection.

In particular, the positioning of a sewing material carrier body in hard-to-reach areas can be facilitated, while reducing the risk of damaging the sewing material.

Advantageously, an angle between a longitudinal axis of the stand-side arm housing section and a longitudinal axis of the head-side arm housing section is not more than 45°, in particular not more than 30°, in particular not more than 15°.

The joint between the stand-side arm housing section and the head-side arm housing section forms a transition area from the stand-side arm housing section to the head-side arm housing section.

A telescopic articulated arm shaft for connecting a drive unit to stitch-forming components in the housing upper part provides an advantageous and cost-effective embodiment of the sewing machine. The telescopic articulated arm shaft is preferably a cardan shaft, such that an operative connection to the stitch-forming components in the housing upper part is maintained even in the preparation position.

A telescopic articulated arm shaft having a stand-side arm shaft joint, a head-side arm shaft joint, and a telescopic element arranged between the stand-side and the head-side arm shaft joint, is advantageous in design. The telescopic element is advantageously used to compensate for length changes due to the swivel movement of the head-side arm housing section from the sewing position to the preparation position and vice versa. Preferably, the telescopic element is connected to the head-side and the stand-side arm shaft joint in a torque-proof manner. In a particularly preferred embodiment, the stand-side and/or the head-side arm shaft joint is designed as a universal joint.

A swivel drive with which the head-side arm housing section can be swiveled into the preparation position or the sewing position ensures that the swivel movement is executed precisely. It is advantageous if the swivel drive is designed as an actuator or a motor. In particular, the swivel drive is a pneumatic, hydraulic or electric cylinder.

The swivel drive, designed as a pneumatic cylinder, is particularly favorable in terms of design. Advantageously, the pneumatic cylinder is designed as a pneumatic cylinder that can be pressurized with compressed air on both sides, also called a double-acting pneumatic cylinder.

A locking unit for holding the head-side arm housing section in the sewing position during sewing ensures that the head-side arm housing section remains in sewing position during sewing. It is advantageous that the head-side arm housing section is additionally secured by pretensioning the swivel drive in the sewing position.

With a locking unit that comprises a pneumatic cylinder, a structurally advantageous and cost-effective embodiment is provided.

A further object of the present disclosure is to provide a sewing unit for sewing multi-dimensional seams lying in space with an improved accessibility and/or workability of the sewing material.

This object is solved by a sewing unit with the sewing machine as described.

Advantageously, the sewing unit is designed as a robot sewing unit. This preferably includes a robotic arm, with which the sewing machine can be oriented in space in five or six degrees of freedom, in a manner controlled as desired. With this embodiment, the sewing material can be fixed in a stationary manner on a holder.

In an advantageous alternative embodiment, the robot arm is arranged on the sewing material carrier body, such that the workpiece can be oriented in space in five or six degrees of freedom, in a manner controlled as desired. With this embodiment, the sewing machine can be fixed in a stationary manner.

An additional object of the present disclosure is to provide a sewing unit for sewing multi-directional seams lying in one plane with an improved accessibility and/or workability of the sewing material.

This object is solved by a sewing unit with a sewing machine as described.

In particular, the sewing unit is designed as a CNC sewing unit.

Advantageously, the sewing unit is designed as programmable large-area automatic sewing machine. With this embodiment, the sewing material is located in a sewing material template. The sewing template is moved on a sewing table according to the seam to be formed.

An additional task of the present disclosure is to provide a method for sewing seams lying multi-dimensionally in space or seams lying multi-directionally in one plane, with which the accessibility of the sewing material is improved.

This object is solved by a method comprising the following steps: Provisioning a sewing unit as described. Swiveling of the head-side arm housing section into a pick-up position to pick up the sewing material to be sewn. Swiveling of the head-side arm housing section into a sewing position. Sewing of at least one seam in the sewing position, and swiveling of the head-side arm housing section into a delivery position for delivering the sewing material.

In the preparation position, the gap to the stitch-forming components in the housing upper part and in the housing lower part is increased such that the risk of damage to the sewing material is reduced. This is particularly advantageous for touch-sensitive materials. The pick-up position for picking up the sewing material to be sewn and the delivery position for delivering the sewing material that is sewn can be the preparation position already explained above in connection with the sewing machine.

A method in which the head-side arm housing section is locked prior to sewing or unlocked after sewing ensures that the sewing can be carried out without disruption.

BRIEF DESCRIPTION OF THE DRAWINGS

An exemplary embodiment of the invention is explained in more detail below using the figures.

DETAILED DESCRIPTION

Figure 1:
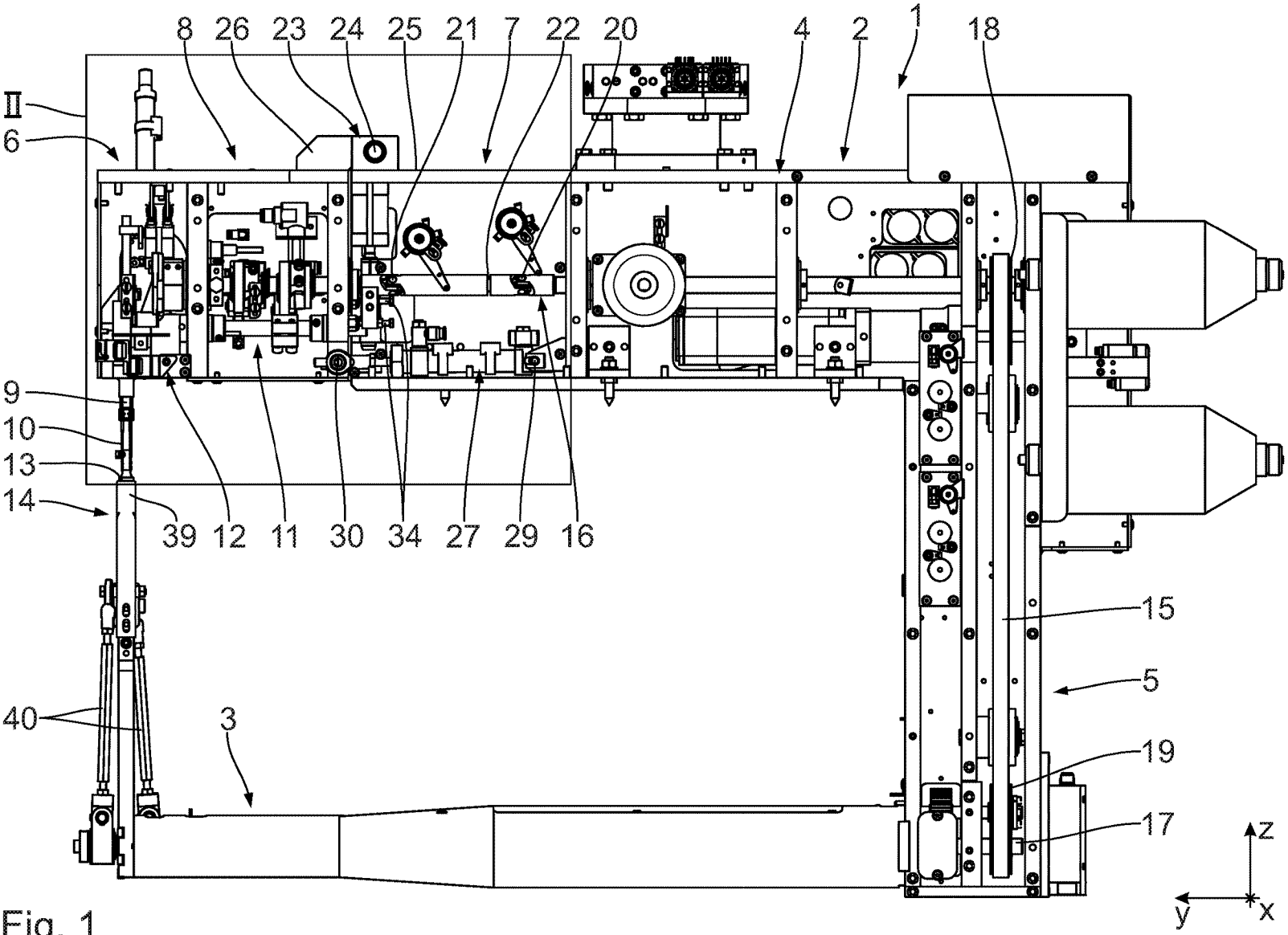
FIG. 1 is a side view, revealing inner details, of a sewing machine of a sewing unit for sewing multi-dimensional seams lying in space in the sewing position.
Figure 2:
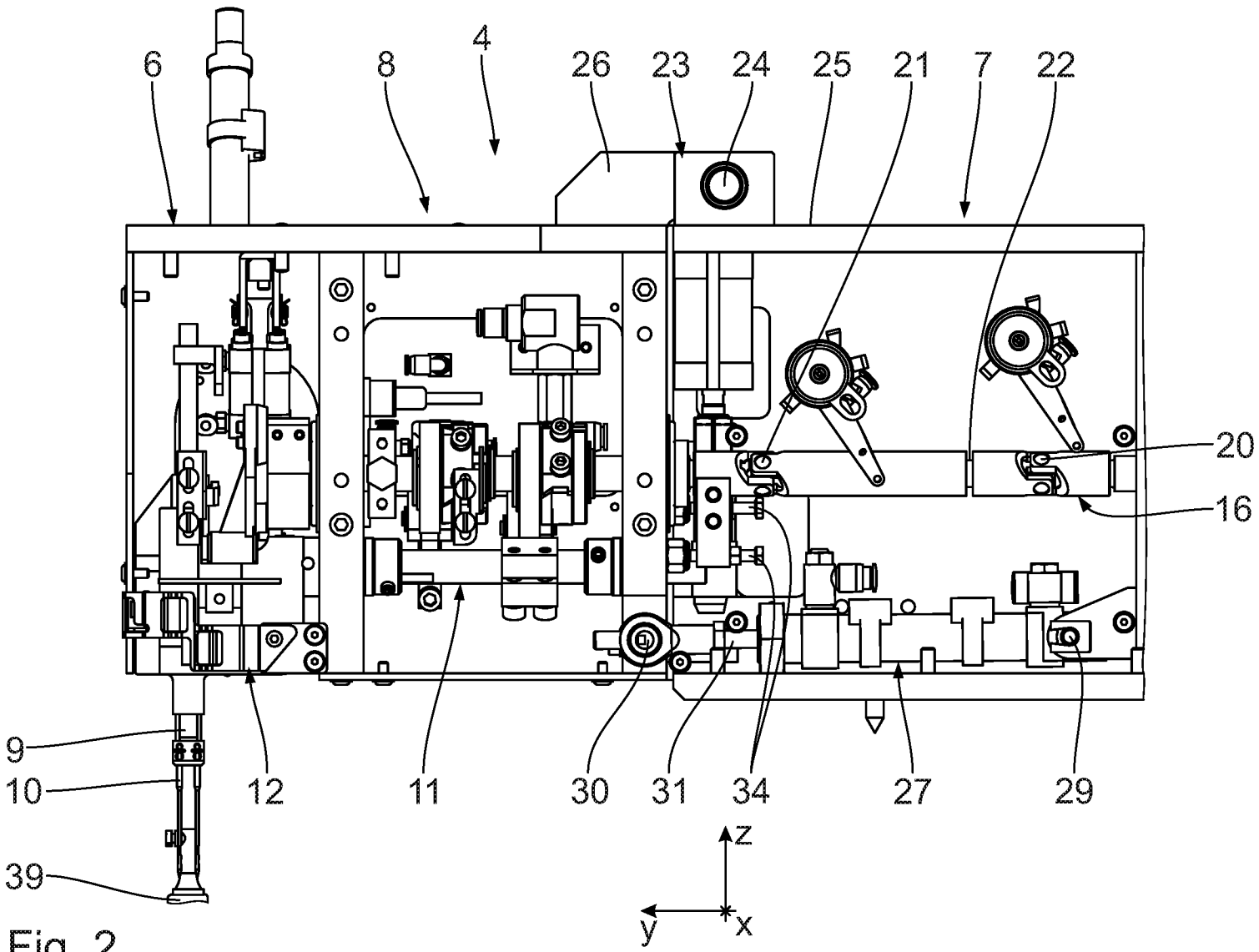
FIG. 2 shows an enlargement of a head-side arm housing section and partially a stand-side arm housing section of the sewing machine according to FIG. 1.

FIGS. 1 to 6 show an embodiment of a sewing unit with a sewing machine 1, which is used in a robot sewing unit, which is not shown. The sewing machine 1 can be used in other sewing units such as a large-area automatic sewing machine, in particular a CNC sewing unit, for sewing multi-directional seams lying in one plane.

The sewing machine 1 shown in detail in FIGS. 1 to 6 for the robot sewing unit is used for sewing seams lying in space, in particular seams that are not flatly three-dimensional in space. An exemplary application for the sewing unit is the attachment of decorative seam applications in the interior of vehicles, for example on instrument panels, door panels or armrests. Preferably, such vehicle interior components consist of so-called "slush skins," which are produced by a powder sintering process. The robot sewing unit includes a robot arm (not shown) with which the sewing machine 1 can be oriented in space in five or six degrees of freedom, in a manner controlled as desired.

To facilitate positional relationships, a Cartesian xyz coordinate system is indicated in the figures. The x-axis is perpendicular to the drawing plane of FIG. 1 and runs into it. The y-direction runs to the left in FIG. 1 and the z-direction runs upwards in FIG. 1.

The sewing machine in FIG. 1 is in the sewing position for sewing multi-dimensional seams lying in space. The sewing machine 1 with a sewing machine housing 2 has a C-shaped basic structure with a housing lower part 3, a housing upper part 4 and a stand 5 connecting the housing lower part 3 and the housing upper part 4. The lower housing part 3 and the upper housing part 4 run along the y-direction. The stand 5 runs along the z-direction.

The upper housing part 4 with a sewing head 6 is divided along the y-direction into a stand-side arm housing section 7 and a head-side arm housing section 8. In the head-side arm housing section 8, stitch-forming components such as a needle bar 9 and the indicated sewing needles 10 attached to it are provided. In addition, a stitch length setting device 11 and a needle feed device 12 are provided in the head-side arm housing section 8.

Another stitch-forming component is a gripper 13, which is driven synchronously with the sewing needle 10 for stitch formation on a lower gripper part 14. The gripper 13 is essentially covered by a stitch plate 39. The gripper lower part 14 forms a column along the z-axis of the sewing machine 1. The gripper lower part 14 is located at the head side of the housing lower part 3. Both the gripper lower part 14 and the housing lower part 3 contain gripper drive components, which are not shown. In addition, the gripper lower part 14 has two levers 40. The latter serve to transmit a movement at a gripper joint, which is not shown in detail.

Due to the column design of the gripper lower part 14, a stitch formation area, in which the seam is produced with sewing machine 1, is freely accessible from all sides.

A rotary motion is generated via a drive motor with a drive shaft (not shown), such that the stitch-forming components, that is, the needle bar 9 with the needle 10 and the gripper 13, are driven. Via a toothed belt 15, the rotary motion is transmitted to a telescopic articulated arm shaft 16 in the housing upper part 4 and to a lower arm shaft 17 in the housing lower part 3. The lower arm shaft 17 is in operative connection with other gripper drive components to the gripper 13. For this purpose, the toothed belt 15 combs a telescopic upper arm shaft gear 18 and a lower arm shaft gear 19.

The telescopic articulated arm shaft 16 extends along the y-direction in the housing upper part 4 and has a stand-side arm shaft joint 20, a head-side arm shaft joint 21 and a telescopic element 22 arranged between them. The latter is designed as a torque-proof connection, such that transmission of the rotary movement of the telescopic articulated arm shaft 16 to the stitch-forming components, in particular the stitch length setting device 11, is ensured. The stand-side and the head-side arm shaft joint 20, 21 is designed as a universal joint, also called a cardan joint. In other words, the telescopic articulated arm shaft 16 is designed as a precision articulated shaft, also called a cardan shaft. This allows torque transmission with an angled shaft train.

Figure 6:
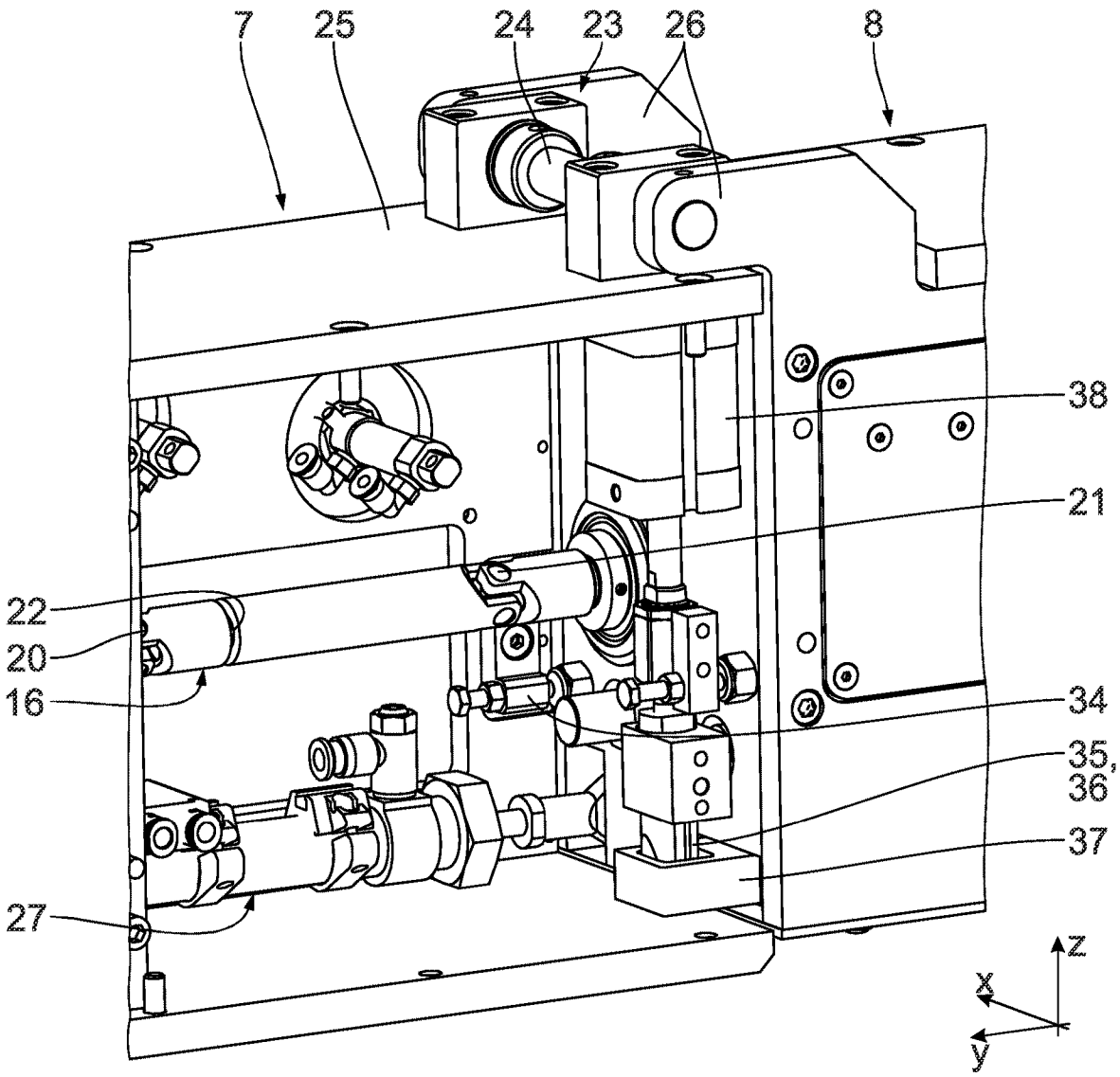
FIG. 6 is a view of the head-side arm housing section according to FIG. 5 in the locked state.

A joint 23 is arranged in the transition area between the stand-side arm housing section 7 and the head-side arm housing section 8. The joint 23 has a joint axis 24 that extends along the x-direction (FIG. 6). The joint 23 is attached to an upper housing wall 25 of the housing upper part 4 in the area of the stand-side arm housing section 7 and is connected to the head-side arm housing section 8 via a joint bridge 26.

Figure 3:
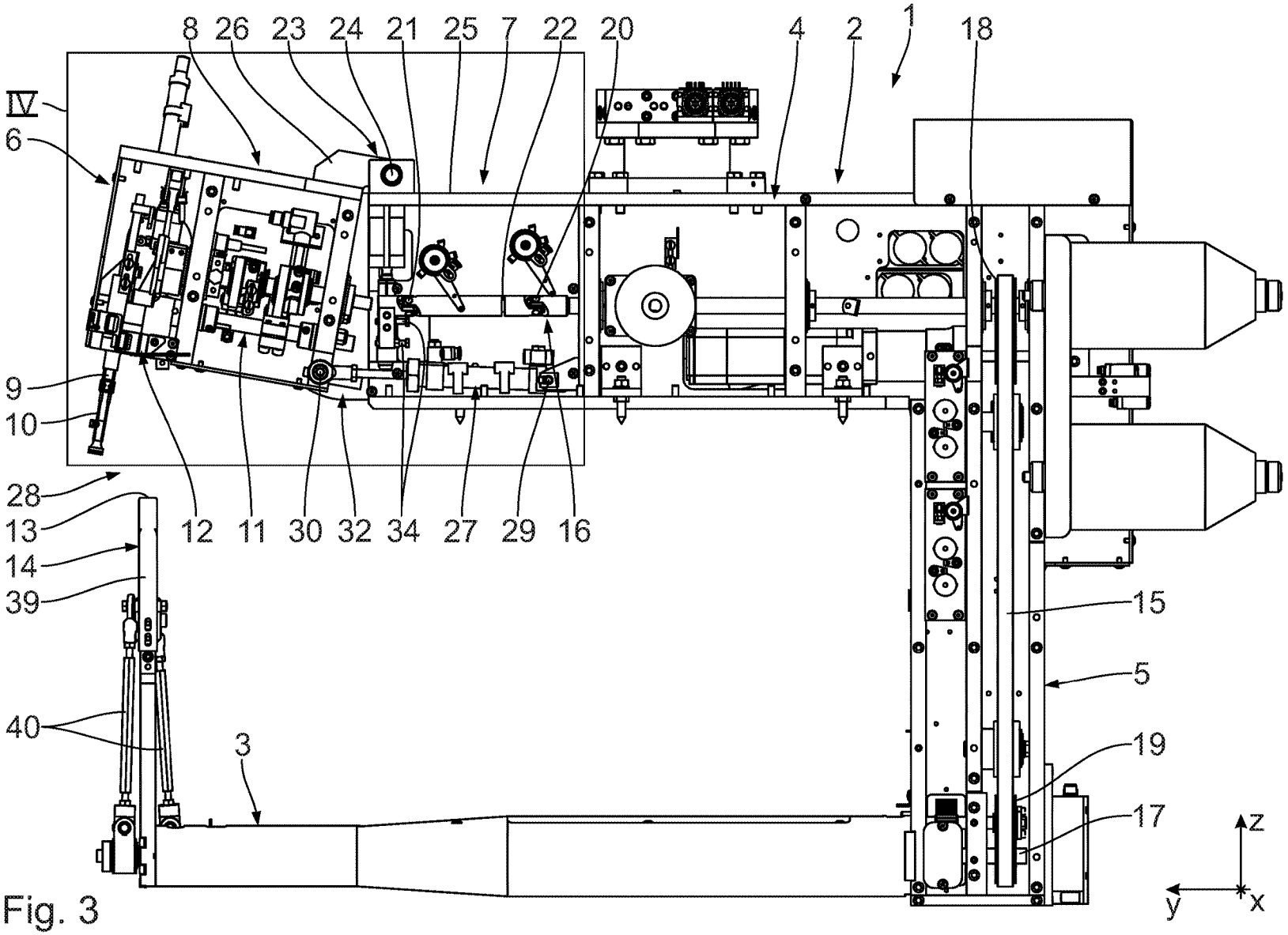
FIG. 3 is a side view of a sewing machine of a sewing unit for the sewing of multi-dimensional seams lying in space in the preparation position, revealing further internal details.
Figure 4:
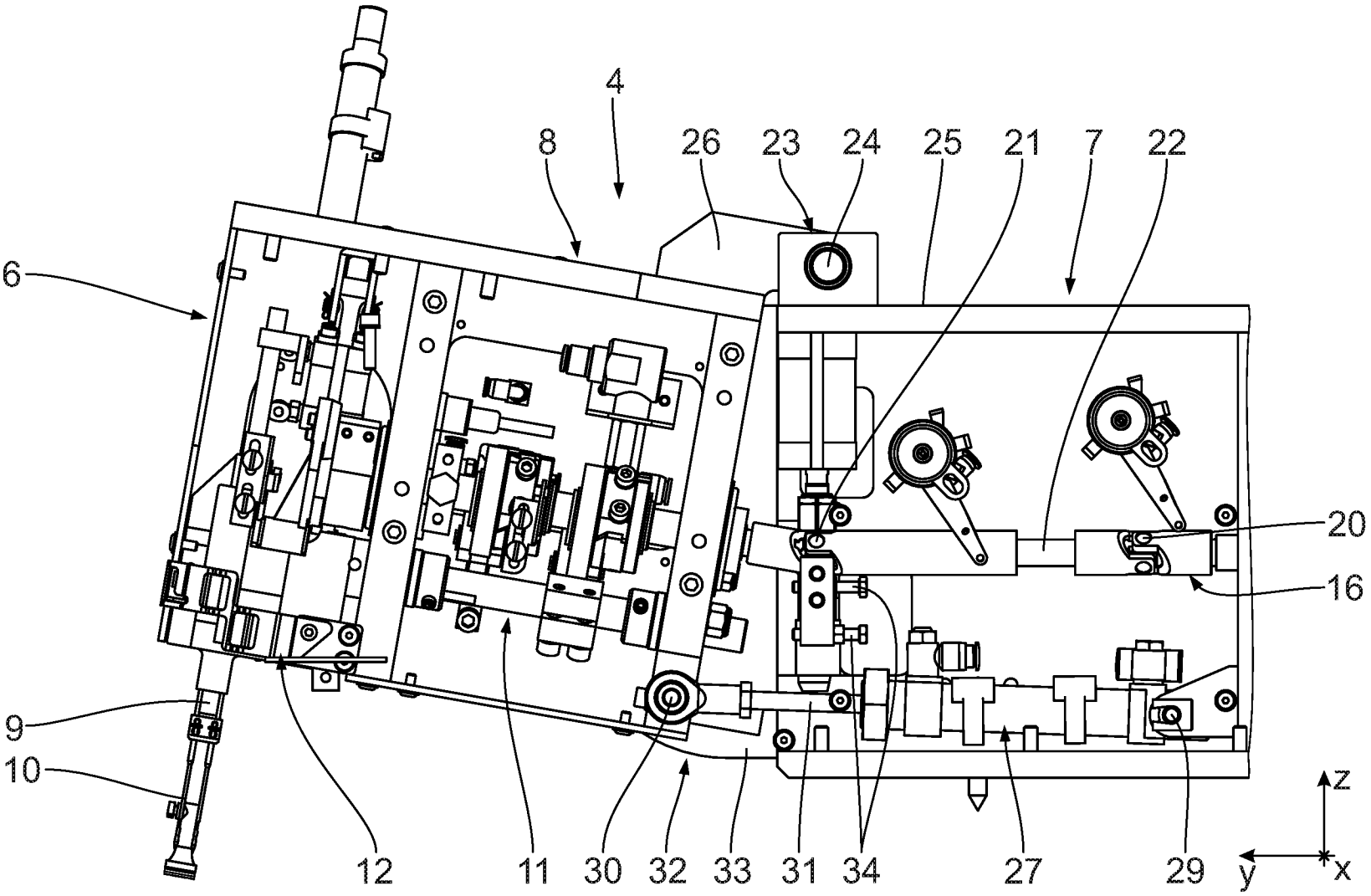
FIG. 4. Is an enlarged illustration of the head-side arm housing section and partially of the stand-side arm housing section of the sewing machine in preparation position according to FIG. 3.

Via a swivel drive 27, the head-side arm housing section 8 is swiveled about the joint axis 24 from the sewing position into a preparation position for picking up/delivering a sewing material (FIGS. 3 and 4). In the embodiment shown, the swivel drive 27 is designed as a pneumatic cylinder.

In the preparation position, the sewing material, which is applied to a sewing material carrier body or a sewing material template, is positioned opposite the stitch-forming components or removed, depending on the stage of the method. Thus, depending on the stage of the method, the preparation position is to be understood as a pick-up position or a delivery position.

In the preparation position, a gap 28 of stitch-forming components, in particular the sewing needle 10, of the head-side arm housing section 8 to the stitch-forming components, in particular the gripper 13 or the stitch plate 39, of the lower housing section 3 is increased in the y and z direction (FIG. 3). This makes it easier to pick up or deliver the sewing material, which is in particular applied to a sewing material carrier body or a sewing material template.

The swivel drive 27 has a stand-side radial bearing 29 and a head-side radial bearing 30, wherein the stand-side radial bearing 29 is provided in the stand-side arm housing section 7 and the head-side radial bearing 30 is provided in the head-side arm housing section 8. The radial bearing on the stand side 29 and the radial bearing on the head side 30 are connected by a partially illustrated working cylinder 31 (see FIG. 3). The swivel movement from the sewing position to the preparation position is performed by the swivel drive 27 in such a manner that the working cylinder 31 is extended to an end position. As a result of the swivel movement, the head-side radial bearing 30 is displaced in the y and z direction.

During the swivel movement from the sewing position to the preparation position, the head-side arm housing section 8 is swiveled up to 40° in relation to the stand-side arm housing section 7. This gives rise to a triangular space 32, wherein the connection between the telescopic articulated arm shaft 16 and the stitch length setting device 11 in the head-side arm housing section 8 is maintained. This is achieved by transferring the telescopic element 22 from a retracted position to an extended position. In such position, the head-side arm shaft joint 21 is displaced in the y direction. At the same time, a partial section of the telescopic articulated arm shaft 16, which is in operative connection with the stitch length setting device 11, is angled.

The resulting triangular space 32 is covered by an indicated cover 33. This prevents dust from penetrating. In addition, a danger point formed by the triangular space 32 is minimized or eliminated for the components that are exposed at least in some areas, in particular the telescopic articulated arm shaft 16.

A swivel movement of the head-side arm housing section 8 from the preparation position to the sewing position is carried out by the swivel drive 27 in such a manner that the working cylinder 31 is retracted until it reaches the stops 34. The space 32 is closed accordingly and the gap 28 is reduced. The head-side arm housing section 8 is in the sewing position.

Figure 5:
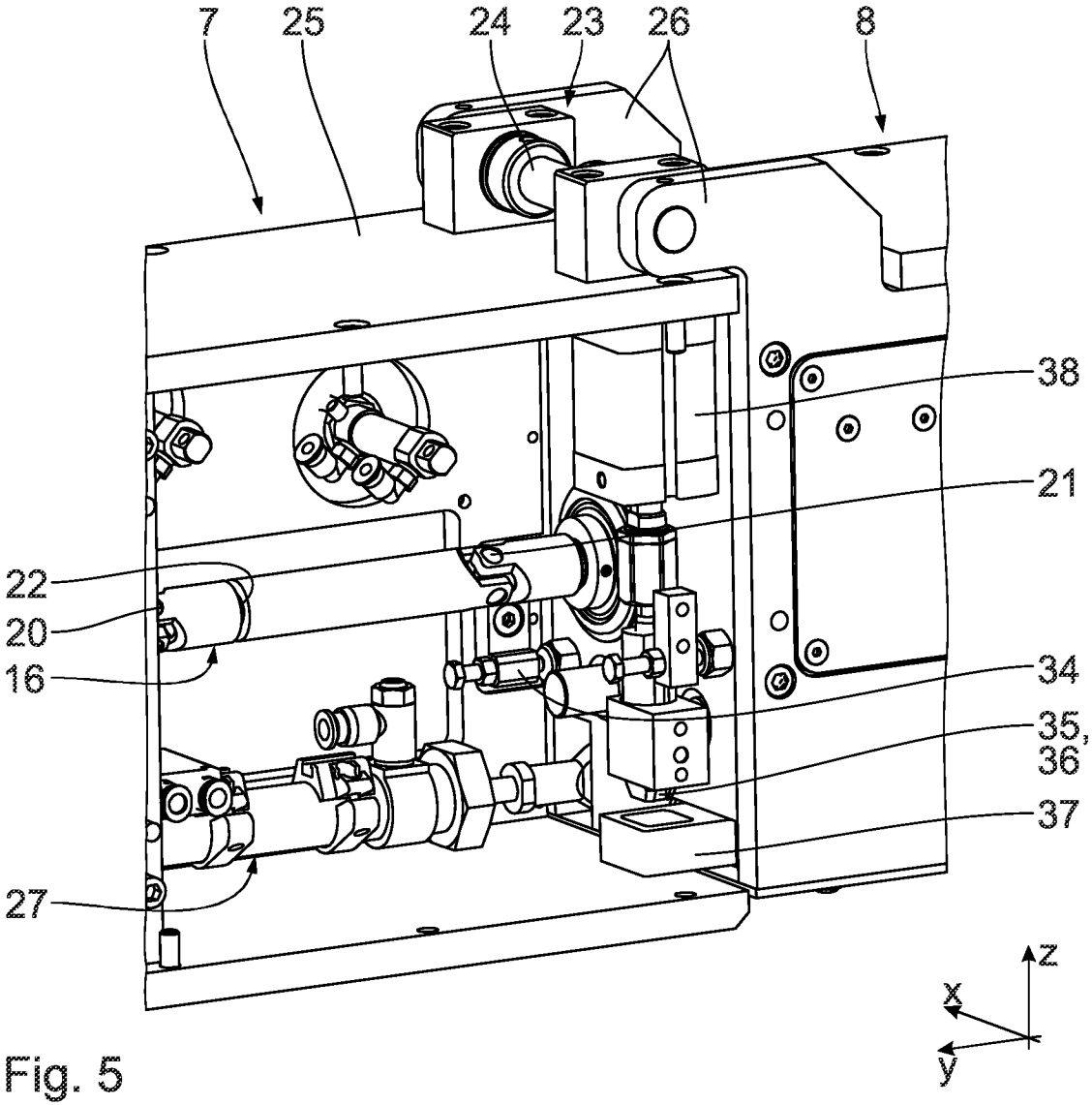
FIG. 5 is a view of the head-side arm housing section in the unlocked state of the sewing machine according to FIG. 1, once again enlarged, revealing inner details.

A locking unit 35 is provided for securing the head-side arm housing section 8 in sewing position during sewing (FIGS. 5 and 6). This comprises a pin 36 and a closing part 37, wherein the pin 36 is arranged in the stand-side arm housing section 7 and the closing part 37 is fastened in the head-side arm housing section 8 and projects into the stand-side arm housing section 7 in the sewing position (FIG. 6). A pneumatic cylinder 38 is used to move the pin 36 into the closing part 37 for locking and the pin 36 out of the closing part 37 for unlocking. For the additional securing of the head-side arm housing section 8 in the sewing position during sewing, pressure is applied to the working cylinder 31.

In the following, a method for sewing seams lying multi-dimensionally in space is described in more detail. For this purpose, it is noted that the method is similar irrespective of the sewing machine.

Initially, the head-side arm housing section 8 is in the sewing position and is unlocked (FIGS. 1, 3 and 5). To pick up a sewing material to be sewn, which is in particular applied to a sewing material carrier body, the head-side arm housing section 8 is swiveled into a pick-up position. Here, the pick-up position is understood to mean the preparation position described above. Accordingly, the head-side arm housing section 8 is swiveled by extending the working cylinder 31 of the swivel drive 27 to the end position. This gives rise to the gap 28, such that the sewing material to be sewn can be aligned with the gripper 13 and the gripper lower part 14.

If the sewing material to be sewn is aligned, the head-side arm housing section 8 is swiveled from the pick-up position to the sewing position. This is achieved by moving the working cylinder 31 of the swivel drive 27 up to the stops 34.

In this position, the head-side arm housing section 8 is locked by pressurizing the working cylinder 31. In addition, the head-side arm housing section 8 is locked with the locking unit 35 before the sewing operation is started. For this purpose, the pin 36 moves into the closing part 37 by means of the pneumatic cylinder 38.

Subsequently, at least one seam is sewn. The seam itself can be designed as a double lockstitch, a single lockstitch or a double chain stitch. Depending on the sewing unit, at least one seam lying multi-dimensionally in space or at least one seam lying multi-directionally in one plane is sewn.

When the sewing is finished, the head-side arm housing section 8 is unlocked. For this purpose, the pin 36 moves out of the closing part 37 by means of the pneumatic cylinder 38.

Subsequently, the working cylinder 31 is extended again to the end position, such that the head-side arm housing section 8 is swung into the delivery position. Here, the delivery position is understood to mean the preparation position described above. Correspondingly, the gap 28 between the sewing needle 10 and the gripper 13 is once again increased, such that the sewing material that is sewn can be removed.

Depending on the application, a new sewing material to be sewn can now be positioned.

The invention claimed is:

1. A sewing machine with a sewing machine housing (2), comprising:

a housing lower part (3);

a housing upper part (4) with a sewing head (6); and a stand (5) that connects the housing lower part (3) to the housing upper part (4), wherein the housing upper part (4) comprises a stand-side arm housing section (7), a head-side arm housing section (8), and a joint (23) which pivotally connects the stand-side arm housing section (7) and the head-side arm housing section (8)

such that the head-side arm housing section (8) can be swiveled between a preparation position for pick up/delivery of sewing material and a sewing position for sewing the sewing material, the sewing machine further comprising a telescopic articulated arm shaft (16) for connecting a drive unit to stitch-forming components in the housing upper part (4), wherein the telescopic articulated arm shaft (16) has a stand-side arm shaft joint (20) and a head-side arm shaft joint (21), and wherein a telescopic element (22) is arranged between the stand-side and the head-side arm shaft joint (20, 21).

2. The sewing machine according to claim 1, further comprising a swivel drive (27) with which the head-side arm housing section (8) can be swiveled into the preparation position or the sewing position.

3. The sewing machine according to claim 2, wherein the swivel drive (27) is a pneumatic cylinder.

4. The sewing machine according to claim 1, further comprising a locking unit (35) for holding the head-side arm housing section (8) in the sewing position during sewing.

5. The sewing machine according to claim 4, wherein the locking unit (35) comprises a pneumatic cylinder (38).

6. A sewing unit for sewing multi-dimensional seams lying in space comprising the sewing machine (1) according to claim 1 and a robot arm with which the sewing machine (1) can be oriented in space in a controlled manner.

7. A sewing unit for sewing multi-directional seams lying in one plane comprising the sewing machine (1) according to claim 1 and a sewing material template which is movable on a sewing table according to a seam to be formed in a controlled manner.

8. A method for sewing multi-dimensional seams lying in space or multi-directional seams lying in one plane, comprising the method steps of provision the sewing unit according to claim 6, swiveling the head-side arm housing section (8) into a pick-up position to pick up the sewing material to be sewn, swiveling the head-side arm housing section (8) into a sewing position, sewing at least one seam in the sewing position and swiveling the head-side arm housing section (8) into a delivery position for delivering the sewing material.

9. The method according to claim 8, wherein the head-side arm housing section (8) is locked prior to sewing or unlocked after sewing.

* * * * *